United States Patent [19]

Uehara

[11] Patent Number: 4,834,362

[45] Date of Patent: May 30, 1989

[54] CIRCULATING-BILL PRESSING-DOWN APPARATUS FOR BILL RECEIVING AND DISPENSING MACHINE

[75] Inventor: Kazuhiro Uehara, Tokyo, Japan

[73] Assignee: Laurel Bank Machines Co., Ltd., Tokyo, Japan

[21] Appl. No.: 113,852

[22] Filed: Oct. 29, 1987

[30] Foreign Application Priority Data

Oct. 30, 1986 [JP] Japan ..... 61-167114[U]

[51] Int. Cl.[4] ..... B65H 5/06

[52] U.S. Cl. ..... 271/3.1; 271/165; 271/176; 271/220

[58] Field of Search ..... 271/3.1, 187, 315, 160, 271/165, 176, 177, 180, 220

[56] References Cited

U.S. PATENT DOCUMENTS

| | | | |
|---|---|---|---|
| 3,977,669 | 8/1976 | Douno | 271/180 |
| 4,339,119 | 7/1982 | Sasaki | 271/180 |
| 4,465,192 | 8/1984 | Ohba | 271/3.1 X |
| 4,552,351 | 11/1985 | Tsukamoto | 271/3.1 |

FOREIGN PATENT DOCUMENTS

| | | |
|---|---|---|
| 58-39392 | 3/1983 | Japan . |
| 60-59492 | 4/1985 | Japan . |
| 60-67334 | 4/1985 | Japan . |
| 078332 | 5/1985 | Japan . |
| 60-78332 | 5/1985 | Japan . |
| 60-100283 | 6/1985 | Japan . |
| 60-251487 | 12/1985 | Japan . |
| 61-18087 | 1/1986 | Japan . |

*Primary Examiner*—Richard A. Schacher

*Attorney, Agent, or Firm*—Fleit, Jacobson, Cohn & Price

[57] ABSTRACT

A circulating-bill pressing-down apparatus used for a bill receiving and dispensing machine having a circulating-bill pressing-down means for pressing down accumulated bills from the top thereof to provide to a roller sufficient frictional force for feeding out the bills. According to the present invention, the bill pressing-down plate is projected only when the amount of the accumulated bills becomes less than a predetermined level. This makes it possible to reduce the vertical displacement of the bill pressing-down plate as compared with the bill pressing-down member of the prior art in which it always presses down the accumulated bills and therefore it also makes it possible to reduce the size of the mechanism for vertically driving the bill pressing-down plate as well as the overall size of the bill receiving and dispensing machine. Furthermore, according to the present invention, the number of retractions and projections of the bill pressing-down plate is reduced since the bill pressing-down plate is actuated only when the amount of the accumulated bills becomes less than the predetermined level. This makes it possible to shorten the operation cycle time of the bill receiving and dispensing machine and also to reduce the manufacturing cost thereof.

1 Claim, 4 Drawing Sheets

CIRCULATING-BILL PRESSING-DOWN APPARATUS FOR BILL RECEIVING AND DISPENSING MACHINE

BACKGROUND OF THE INVENTION

The present invention relates to a bill receiving and dispensing machine of bill-circulation type including a circulating-bill pooling means for pooling received bills in vertically accumulated condition and a circulating-bill feeding-out means having a roller for contacting the lowermost bill of the accumulated bills to feed out the accumulated bills in order from the lowermost bill by friction between the roller and the lowermost bill, and more particularly to a circulating-bill pressing-down apparatus used for the bill receiving and dispensing machine having a circulating-bill pressing-down means for pressing down the accumulated bills from the top thereof to provide to the roller sufficient frictional force for feeding out the bills.

Heretofore, there have been proposed bill receiving and dispensing machines which permit the received bills to be reused as the bills for dispensation. Such a bill receiving and dispensing machine is so constructed that it has a circulating-bill pooling means arranged intermediate of a received bill transferring route for pooling the received bills to be reused as dispensing bills and a circulating-bill feeding-out means arranged below the circulating-bill pooling means for feeding out the accumulated bills one by one from the lowermost side thereof by a roller in contact with the lowermost bill, and that the circulating-bill pooling means is provided with a bill containing box having a port arranged at the top thereof for receiving the received bills and an opening arranged at the bottom thereof for forming an entrance and an exit for the roller.

Such a bill receiving and dispensing machine is usually required to have a bill pressing-down means which presses the accumulated bills from the top thereof to provide to the roller sufficient frictional force for feedng out the bills. For example, Japanese laid-open utility model publication No. 078332/1985 discloses a bill pressing-down means of this type in which a bill pressing-down member for pressing down the accumulated bills from the top thereof toward a roller of the bill feeding-out mechanism is always urged toward the top of the accumulated bills regardless of the amount of the accumulated bills.

However, in the bill receiving and dispensing machine, since the bill pressing-down member must be retracted from the accumulated bills while the received bills are being supplied to the circulating-bill pooling means, frequent retracting and projecting motions of the bill pressing-down member of the prior art are required for receiving the bills into the circulating-bill pooling means. This makes it difficult to shorten the operation cycle time of the bill receiving and dispensing machine. In addition, the bill pressing-down means must be strongly constructed so as to be able to bear the frequent retracting and projecting motions of the bill pressing-down member and accordingly this increases the manufacturing cost of the bill receiving and dispensing machine.

Also, since the bill pressing-down member must move a long vertical distance from zero to maximum height of the accumulated bills so as to always ensure the bill pressing-down operation thereof regardless of the amount of the accumulated bills, it is difficult to realize a bill pressing-down means of small size or to reduce the overall size of the bill receiving and dispensing machine.

SUMMARY OF THE INVENTION

It is an object of the present invention to provide a circulating-bill pressing down-apparatus for bill receiving and dispensing machine which can shorten the operation cycle time of the bill receiving and dispensing machine and also enable reduction of the overall size thereof.

According to the present invention, there is provided a circulating-bill pressing-down apparatus for a bill receiving and dispensing machine including circulating-bill pooling means for pooling received bills in vertically accumulated condition to reuse them for dispensation; circulating-bill feeding-out means having a roller able to contact the lowermost bill accumulated in the circulating-bill pooling means and adapted to feed out in order the accumulated bills from the lowermost bill by friction between the roller and the bill; and circulating-bill pressing-down means for pressing down the accumulated bills from the top thereof to provide to the roller sufficient frictional force for feeding out the bills, characterized in that the circulating-bill pressing-down means comprises a bill amount detecting sensor for detecting the amount of bills accumulated in the circulating-bill pooling means; a bill pressing-down plate for pressing down the accumulated bills from the top thereof; and a bill pressing-down plate driving mechanism controlled by a signal from the bill amount detecting sensor and adapted to retract the bill pressing-down plate toward the side of the accumulated bills when the amount of the accumulated bills exceeds a predetermined level and to project the bill pressing-down plate toward the top of the accumulated bills so that the bill pressing-down plate presses down the accumulated bills when the amount of the accumulated bills becomes less than the predetermined level.

The circulating-bill pressing-down apparatus of the present invention is provided with a bill amount detecting sensor for detecting the amount of the bills accumulated in the circulating-bill pooling means. When the detected amount of the accumulated bills exceeds a predetermined level and the weight of the accumulated bills can provide the roller with sufficient frictional force for feeding out the bills, the bill pressing-down plate is kept in a retracted position from the accumulated bills toward the side thereof, and, on the other hand, when the detected amount of the accumulated bills becomes less than the predetermined level and the weight of the accumulated bills cannot provide the roller with sufficient frictional force for feeding out the bills, the bill pressing-down plate is projected toward the top of the accumulated bills so as to press them down.

That is, according to the present invention, the bill pressing-down plate is projected only when the amount of the accumulated bills becomes less than the predetermined level. This makes it possible to reduce the vertical displacement of the bill pressing-down plate as compared with the bill pressing-down member of the prior art in which it always presses down the accumulated bills and therefore it also makes it possible to reduce the size of the mechanism for vertically driving the bill pressing-down plate as well as the overall size of the bill receiving and dispensing machine.

Further, according to the present invention, the number of retractions and projections of the bill pressing-down plate is reduced since the bill pressing-down plate is actuated only when the amount of the accumulated bills becomes less than the predetermined level. This makes it possible to shorten the operation cycle time of the bill receiving and dispensing machine and also to reduce the manufacturing cost thereof.

BRIEF DESCRIPTION OF THE DRAWINGS

Other objects and advantages of the present invention will become apparent from the following detailed description of preferred embodiment of the present invention taken in reference to the accompanying drawings in which:

FIGS. 1–3 show one embodiment of the circulating-bill pressing-down apparatus of the present invention, wherein FIG. 1 is a side elevational view, FIG. 2 is a plan view, and FIG. 3 is a view along a line III of FIG. 2.

Figure 4:
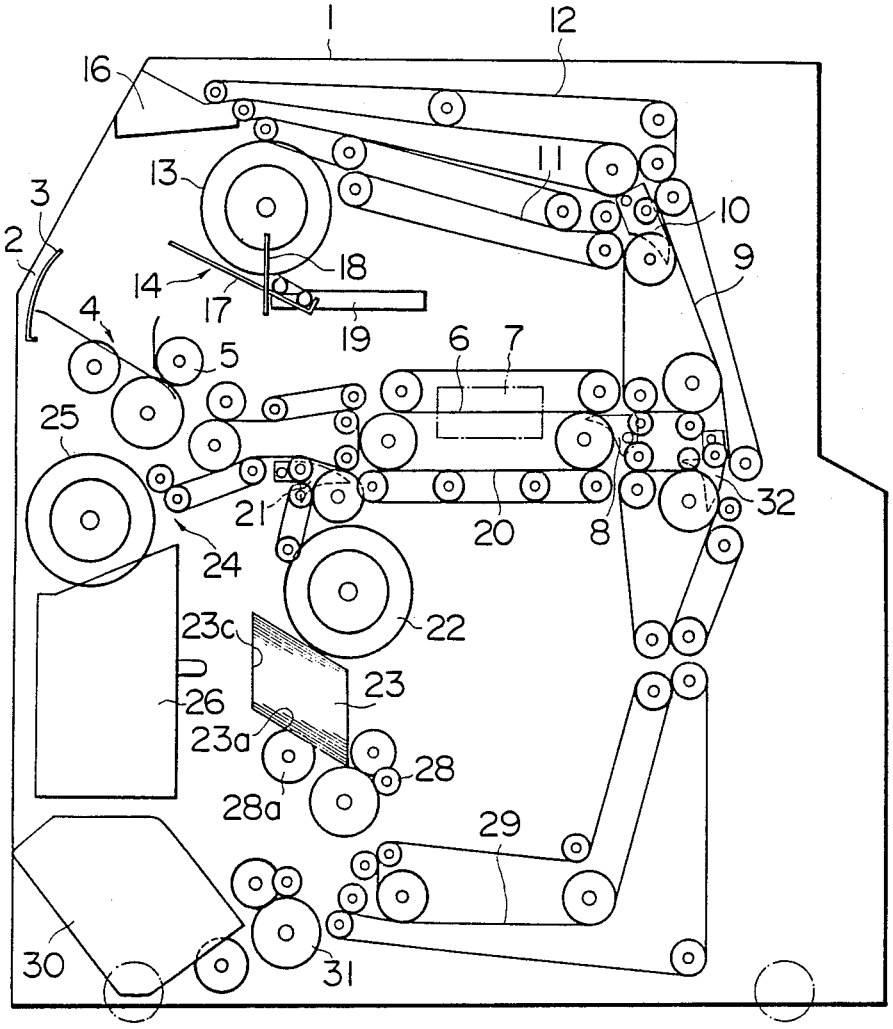
FIG. 4 is a schematic view of the bill receiving and dispensing machine to which the circulating-bill pressing-down apparatus of FIGS. 1–3 is incorporated.

One preferred embodiment of the present invention will be hereinafter described with reference to the attached drawings.

the bill receiving and dispensing machine shown in FIG. 4 is designed for circulating and reusing only 10,000 yen bills as dispensing bills although it receives various bills such as 1,000 yen, 5,000 yen and 10,000 yen bills.

Firstly, the general arrangement of the bill receiving and dispensing machine will be explained referring to FIG. 4.

When a user issues a command requesting bill acceptance, a shutter 3 of a transaction port 2 mounted on a machine body 1 is opened to expose a bill receiving and dispensing mouth 4. In the case that bills (or a bill) are actually inserted into the transaction port 2, the received bills are transferred to a discriminating section 7 through a discriminating route 6. The discriminated bills are guided into a common route 9 by a first fork 8. Bills discriminated as genuine at the discriminating section 7 are guided by a second fork 10 into an accumulating route 11. On the contrary, bills discriminated as counterfeit are guided into a rejection route 12. The genuine bills passing through the accumulating route 11 are continuously fed via an accumulation wheel 13 for temporary pooling to a bill delivering means 14, and the counterfeit bills passing through the rejection route 12 are fed into a rejection port 16.

The bill delivering means 14 comprises a supporting plate 17 which stands by below the accumulation wheel 13 for temporary pooling, a scraping member 18 for scraping and dropping the bills held by the accumulating wheel 13 onto the supporting plate 17, and an accumulating and transferring mechanism 19 for causing a predetermined motion of the supporting plate 17 so as to deliver the bills accumulated on the supporting plate into the bill receiving and dispensing mouth 4. The bills accumulated on the supporting plate 17 are transferred to a position above the mouth 4 and dropped therein. The bills dropped into the mouth 4 are then transferred to the discriminating route 6 through the received-bill feeding-out mechanism 5 with them pressed down by a bill pressing-down means (not shown in FIG. 4).

The bills discriminated as 10,000 yen bills at discriminating section 7 are guided into a bill receiving route 20 by the first fork 8 and then fed into a circulating-bill pooling means 23 by a third fork 21 through a circulating-bill accumulation wheel 22. On the contrary, bills other than 10,000 yen bills are guided into a received-bill containing means 24 by the third fork 21 and then accommodated in a received-bill box 26 through an accumulation wheel 25 for holding received bills.

When a bill dispensation command is made by the user, the 10,000 yen bills are fed out to a bill dispensing route 29 from the circulating-bill pooling means 23 by a circulating-bill feeding-out means 28. The bills other than 10,000 yen bills, for example, 1,000 yen bills or 5,000 yen bills are supplied beforehand to a dispensation bill containing means (dispensation bill box) 30 and fed out by a dispensation bill feeding-out mechanism 31 to the bill dispensing route 29. During these operations, a check is made for abnormalities, for example, to determine whether the bills for dispensation are being fed n an overlapped condition. When an abnormality is found, such bills are returned to the received bill box 26 of the received-bill containing means 24 by a fourth fork 32, the bill receiving route 20 and the third fork 21. On the contrary, when no abnormality is found, the bills are guided to the common route 9 by the fourth fork 32 and then guided by the second fork 10 to an accumulating route 11. The bills on the accumulating route 11 are fed to the bill delivering means 14 by the accumulation wheel 13 for temporary pooling and then continuously accumulated on the supporting plate 17. After having accumulated thereon to a desired amount of money, the bills on the supporting plate 17 are dropped into the bill receiving and dispensing mouth 4 by driving the accumulating and transferring mechanism 19. Finally, by opening the shutter 3, it permits the user to take out the bills from the mouth 4.

The bills fed by the accumulating wheel 22 are continuously accumulated and pooled in the vertical direction on the circulating-bill pooling means 23 and the accumulated bills are fed out in order by the circulating-bill feeding-out means 28 from the lowermost bill. A circulating-bill pressing-down apparatus of FIGS. 1–3 is provided so as to successfully carry out the bill feeding-out operation with the circulating-bill feeding-out means 28.

Figure 1:
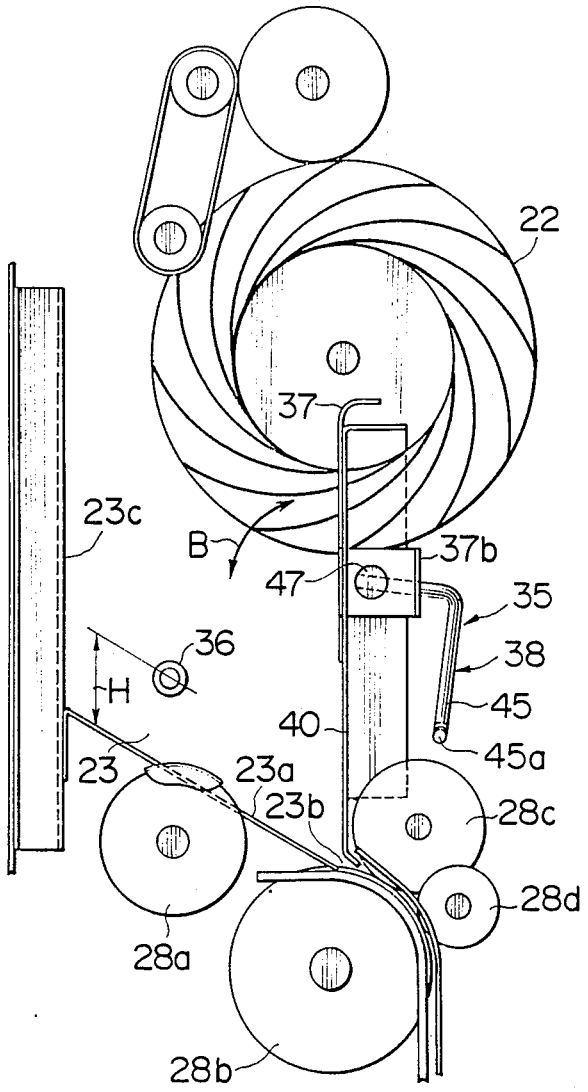
Figure 2:
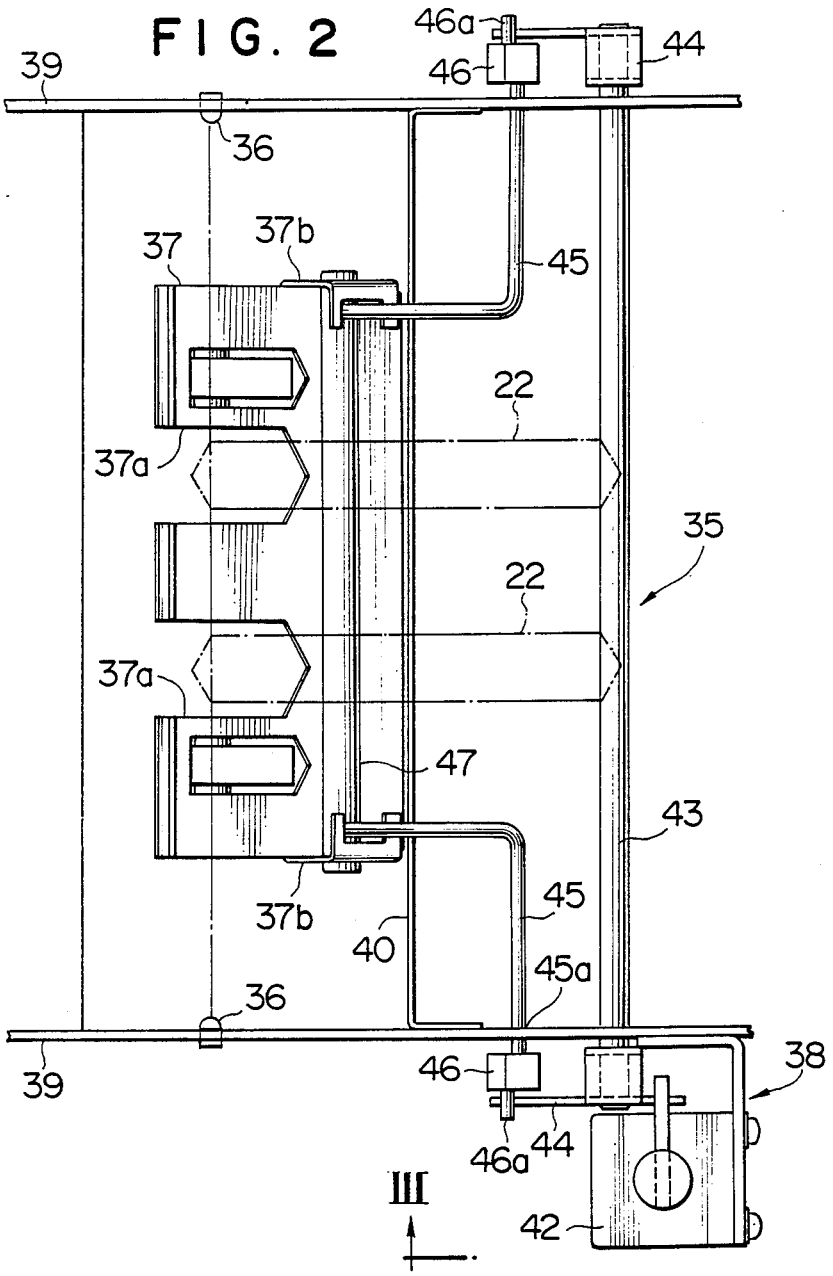
Figure 3:
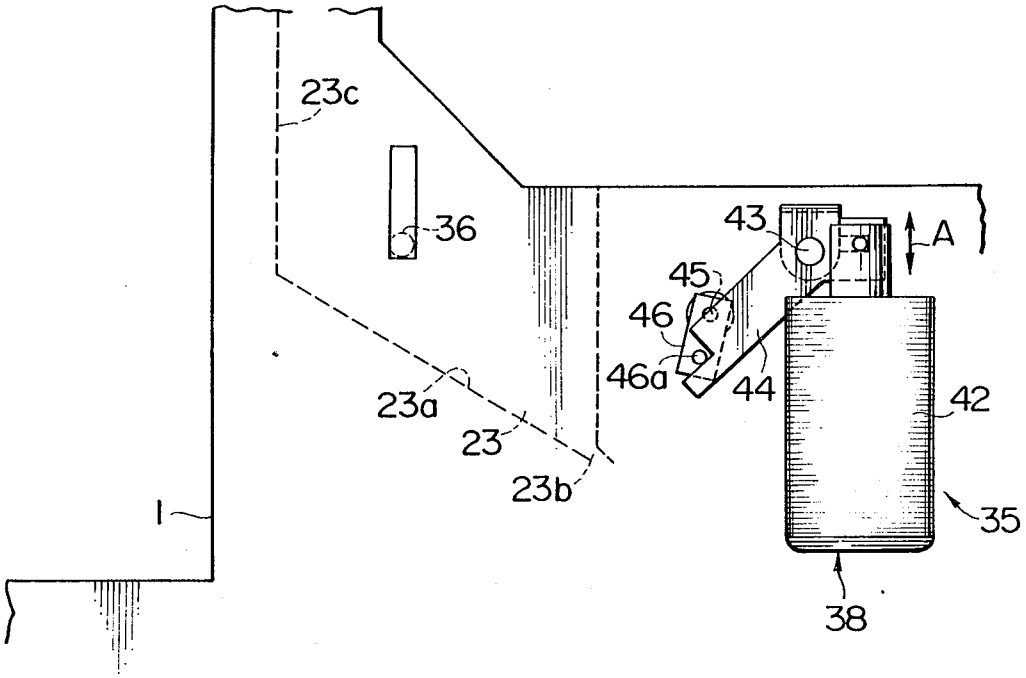

Referring to FIGS. 1–3, the structure of the circulating-bill pooling means 23, the circulating-bill feeding-out means 28 and the circulating-bill pressing-down means 35 will be described.

A shown in FIGS. 1 and 3, the circulating-bill pooling means 23 has an inclined bottom surface **23*a* which descends toward the rear end (rightward in FIG. 1) of the machine body 1 and is formed with a feeding-out port 23*b* at its rear end for feeding out the bills pooled thereon in vertical and inclined condition along the bottom surface 23*a* by the accumulation wheel 22. The circulating-bill pooling means 23 also has a front plate 23*c* arranged at front side of the machine body 1 to define the area of the circulating-bill pooling means 23. The front plate 23*c* of the machine body 1 is provided with an openable door (not shown) to expose the received-bill box 26 integrally mounted on the front plate 23*c* at the front of the machine body 1 so as to enable charging of bills (10,000 yen bills) into the pooling means 23** via the openable door.

The circulating-bill feeding-out means 28 is a friction type means for feeding out bills by friction between a roller and a bill and comprises a roller **28*a* one peripheral portion of which projects into the pooling means 23** through an opening (not shown) formed in the inclined bottom surface 23*a*for contacting the lowermost bill of the accumulated bills and feeding it out to the feeding-out port 23*b*, and separation rollers 28*b*, 28*c* and 28*d* arranged near the feeding-out port 23*b* for separating one by one the bills fed out through the port 23*b* and feeding them to the bill dispensing route 29.

The circulating-bill pressing-down means 35 is for pressing down the bills accumulated in the circulating-bill pooling means 23 so as to provide the roller 28*a* of the circulating-bill feeding-out means 28 with sufficient frictional force for feeding out the accumulated bills and comprises, as shown in FIG. 1, a bill amount detecting sensor 36 for detecting the amount of the accumulated bills in the circulating-bill pooling means 23, a bill pressing-down plate 37 for pressing down the accumulated bills from the top thereof, and a bill pressing-down plate driving mechanism 38 for driving the bill pressing-down plate 37 in accordance with a predetermined motion so as to project the plate 37 into a region of the bill pooling means 23 to engage the top of the accumulated bills and retract it therefrom to discontinue the engagement with the accumulated bills.

The bill amount detecting sensor 36 comprises, for example, light emitting and receiving elements and is adapted to discriminate the amount of bills pooled in the bill pooling means 23 by detecting the height "H" of the bills from the bottom surface 23*a*. A signal from the sensor 36 is output to an electronic control unit (not shown) for controlling a solenoid to drive the bill pressing-down plate driving mechanism 38, as hereinafter dscribed in more detail. The light emitting and receiving elements forming the sensor 36 are mounted on a frame 39 of the machine body 1 at opposite sides of the bill pooling means 23. The height "H" is selected as a level at which the weight of the accumulated bills can provide the roller 28*a* with sufficient frictional force for feeding out the accumulated bills from the bill pooling means 23. Accordingly, when the amount of the bills becomes less than the level "H", the sensor 36 outputs a signal to the control unit so as to project the bill pressing-down plate 37 toward the top of the accumulated bills to press down the accumulated bills toward the roller 28*a* for providing sufficient friction between the roller 28*a* and the lowermost bill for reliably feeding out the bills from the bill pooling means 23.

As shown in FIGS. 1 and 2, the bill pressing-down plate 37 is supported below the circulating-bill accumulation wheel 22 by the plate driving mechanism 38. When the amount of the accumulated bills is more than the level "H" and no pressing-down action of the plate 37 is required, it is rotated by the plate driving mechanism 38 to a retracted position closely adjacent to the scraping plate 40 which rises to scrape the bills from the accumulating wheel 22. On the other hand, when the amount of the accumulated bills becomes less than the level "H" and the pressing-down action of the plate 37 is required, the plate 37 is rotated by the plate driving mechanism 38 into the region of the bill pooling means 23 to press down the top of the accumulated bills. The bill pressing-down plate 37 is formed with notches 37*a* at the forward end thereof to avoid interference with the accumulation wheel 22 and is also formed with projecting connectors 37*b* at the sides thereof for connecting the plate 37 to the plate driving mechanism 38.

As shown in FIGS. 1–3, the plate driving mechanism 38 comprises a solenoid 42, a shaft 43 rotatably mounted by the frame 39, levers 44 each fixedly connected to the end of the shaft 43 for converting the linear motion of the solenoid 42 shown by an arrow "A" to a rotational motion around the shaft 43, levers 45 each rotatably supported by the frame 39 via a bearing 45*a*, engaging blocks 46 each fixedly connected to one end of the lever 45 and having an engaging pin 46*a* adapted to be able to engage the converting lever 44 to rotate the lever 45 in response to the rotation of the converting lever 44, and a supporting shaft 47 rotatably supporting the bill pressing-down plate 37 via the connectors 37*a* of the plate 37 and fixedly connected to the other end of the levers 45. With this construction, when the solenoid 42 is extended (or retracted) along the arrow "A", the levers 45 and acccordingly the supporting shaft 47 are rotated around their pivotal center (i.e. bearings 45*a*) and thus the bill pressing-down plate 37 is projected (or retracted) into or from the region of the circulating-bill pooling means 23 along an arrow "B" (FIG. 1).

The extending and retracting motion of the solenoid 42 is controlled by the signal from the bill amount detecting sensor 36 so as to retract the bill pressing-down plate 37 toward the side of the accumulated bills (in the condition shown in FIG. 1) when the amount of the accumulated bills exceeds the level "H" and conversely, so as to project the bill pressing-down plate 37 toward the accumulated bills to press down the top thereof when the amount of the accumulated bills becomes less than the level "H". Since the bill pressing-down plate 37 is rotatably held by the supporting shaft 47, the pressing-down force is equally distributed over the top of the accumulated bills.

According to the present invention, the bill pressing-down plate is projected only when the amount of the accumulated bills becomes less than the predetermined level. This makes it possible to reduce the vertical displacement of the bill pressing-down plate as compared with the bill pressing-down member of the prior art in which it always presses down the accumulated bills and therefore it also makes it possible to reduce the size of the mechanism for vertically driving the bill pressing-down plate as well as the overall size of the bill receiving and dispensing machine.

Furthermore, according to the present invention, the number of retractions and projections of the bill pressing-down plate is reduced since the bill pressing-down plate is actuated only when the amount of the accumulated bills becomes less than the predetermined level. This makes it possible to shorten the operation cycle time of the bill receiving and dispensing machine and also to reduce the manufacturing cost thereof.

What we claim is:

1. A circulating-bill pressing-down apparatus for a bill receiving and dispensing machine, said apparatus comprising:

circulating-bill pooling means for pooling received bills in a vertically accumulated condition to reuse the bills for dispensation;

circulating-bill feeding-out means having a roller for contacting a lowermost bill accumulated in said circulating-bill pooling means for feeding out in order the accumulated bills from the lowermost bill by friction between the roller and the bill; and circulating-bill pressing-down means for pressing down the accumulated bills from the top thereof to provide to the roller sufficient frictional force for feeding out the bills, and said circulating-bill pressing-down means including a bill amount detecting sensor for detecting the amount of bills accumulated in said circulating-bill pooling means, a bill pressing-down plate for pressing down the accumulated bills from the top thereof, and a bill pressing-down plate driving mechanism controlled by a signal from said bill amount detecting sensor for retracting the bill pressing-down plate toward the side of the accumulated bills when the amount of the accumulated bills exceeds a predetermined level and to project said bill pressing-down plate toward the top of the accumulated bills so that said bill pressing-down plate presses down the accumulated bills when the amount of the accumulated bills becomes less than the predetermined level.

* * * * *